United States Patent [19]

Borsenberger et al.

[11] Patent Number: 4,471,039

[45] Date of Patent: Sep. 11, 1984

[54] PHOTOCONDUCTIVE ELEMENTS SENSITIVE TO RADIATION IN THE INFRARED REGION OF THE SPECTRUM

[75] Inventors: Paul M. Borsenberger, Hilton; Michael T. Regan, Fairport; Carl F. Groner, Rochester, all of N.Y.

[73] Assignee: Eastman Kodak Company, Rochester, N.Y.

[21] Appl. No.: 443,519

[22] Filed: Nov. 22, 1982

[51] Int. Cl.[3] ..... G03G 5/04

[52] U.S. Cl. ..... 430/58; 430/59; 430/76; 430/96; 430/64; 260/245.87

[58] Field of Search ..... 430/58, 59, 76, 64, 430/96; 260/245.87

[56] References Cited

U.S. PATENT DOCUMENTS

| | | | |
|---|---|---|---|
| 3,615,558 | 10/1971 | Carreira et al. | 96/88 |
| 3,903,107 | 9/1975 | Griffiths et al. | 260/314.5 |
| 4,031,109 | 6/1977 | Griffiths et al. | 430/76 |
| 4,226,928 | 10/1980 | Nakazawa et al. | 430/81 |
| 4,399,208 | 8/1983 | Takasu et al. | 430/59 |

OTHER PUBLICATIONS

Regensburger et al., J. Non-Cryst. Solids 6, 13-26, (1971).
Hackett, J. Chem. Phys., 55, 3178-3187 (1971).
Minami, J. Chem. Phys., 72, 6317-6318 (1980).
Muhl, Kristall Technik, 223, 431 (1967).
Arishima et al., Appl. Phys. Lett. 40(3) 1 Feb. 1982, pp. 279-280.

*Primary Examiner*—John E. Kittle
*Assistant Examiner*—John L. Goodrow
*Attorney, Agent, or Firm*—Bernard D. Wiese

[57] ABSTRACT

Photoconductive elements comprising a support, a $\beta$-phase indium phthalocyanine charge generation layer and a charge transport layer have excellent photosensitivity in the infrared region of the electromagnetic spectrum.

30 Claims, 3 Drawing Figures

Figure 1:
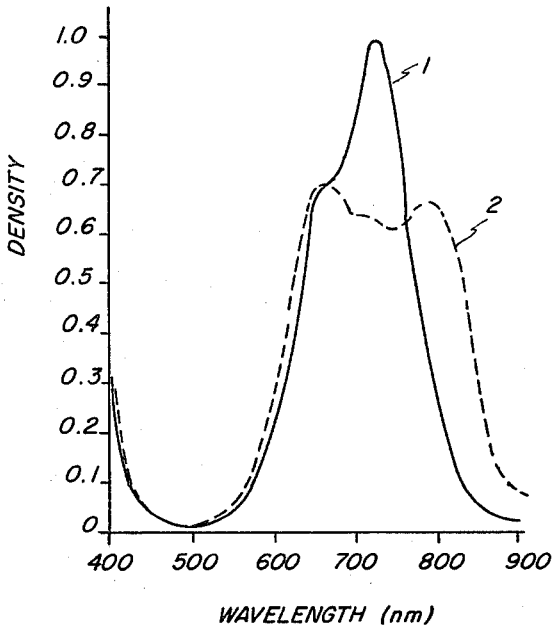

PHOTOCONDUCTIVE ELEMENTS SENSITIVE TO RADIATION IN THE INFRARED REGION OF THE SPECTRUM

This invention relates to novel photoconductive elements. In a particular aspect it relates to such elements which are sensitive to radiation in the infrared region of the spectrum.

Photoconductive materials have been described as having the ability to generate mobile charge carriers as a result of exposure to actinic radiation and to transport them through the bulk of the material. This property has formed the basis for the art of electrophotography and finds use in other technologies, such as solar cells.

Photoconductive elements comprise a conducting support bearing a layer of a photoconductive material which is insulating in the dark but which becomes conductive upon exposure to actinic radiation. A common technique for forming images with such elements is to uniformly electrostatically charge the surface of the element and then imagewise expose it to actinic radiation. In areas where the photoconductive layer is irradiated, mobile charge carriers are generated which migrate to the surface of the element and there dissipate the surface charge. This leaves behind a charge pattern in nonirradiated areas, referred to as a latent electrostatic image. This latent electrostatic image can then be developed, either on the surface on which it is formed, or on another surface to which it has been transferred, by application of a liquid or dry developer composition which contains finely divided electroscopic marking particles that either are selectively attracted to and deposit in the charged areas or are repelled by the charged areas and selectively deposited in the uncharged areas. The pattern of marking particles can be fixed to the surface on which they are deposited or they can be transferred to another surface and fixed there.

Numerous photoconductive materials have been described as being useful in electrophotography. These include inorganic materials, the best known of which are selenium and zinc oxide, as well as organic materials, both monomeric and polymeric, such as arylamines, arylmethanes, azoles, carbazoles, pyrroles, phthalocyanines and the like.

Electrophotographic elements can comprise a single active layer, containing the photoconductive material, or they can comprise multiple active layers. Elements with multiple active layers (sometimes referred to as multi-active elements) have at least one charge generation layer and at least one charge transport layer. The charge generation layer responds to actinic radiation by generating mobile charge carriers and the charge transport layer facilitates migration of the charge carriers to the surface of the element, where they dissipate the uniform electrostatic charge and thus form the latent electrostatic image.

The majority of photoconductors described in the art are sensitive to electromagnetic radiation in the ultraviolet and visible regions of the electromagnetic spectrum. However, as information storage and retrieval technology has evolved, increasing use has been made of diode lasers, light emitting devices which emit radiation principally in the near infrared region of the electromagnetic spectrum, i.e., from about 700 nm to about 900 nm. Known photoconductive materials either do not adequately respond to radiation in this region of the spectrum, i.e., they have little or no sensitivity to such radiation, or, if they do respond to such radiation they suffer from other disadvantages. For example they may have very high dark conductivities, which limit their ability to accept and hold an electrostatic charge, or they may have poor quantum efficiencies, which prevent them from making effective use of exposing radiation and results in low electrophotographic sensitivity, or they may require the application of an extremely high electrostatic charge or the use of other extreme conditions in order to exhibit useful electrophotographic sensitivity.

Thus, there has existed a need for photoconductive elements sensitive to the near infrared region of the electromagnetic spectrum. These elements should have low dark decay properties, high electrophotographic sensitivity and they should be useful under commonly encountered conditions.

We have found that when the $\beta$-phase of an indium phthalocyanine pigment is used as the charge generation layer in a multi-active element, the element exhibits high electrophotographic sensitivity in the near infrared region of the electromagnetic spectrum.

Multi-active photoconductive elements containing a $\beta$-phase indium phthalocyanine charge generation layer, in addition to exhibiting high electrophotographic sensitivity, exhibit high charge acceptance, low dark decay and high quantum efficiency. This is unexpected since, although phthalocyanine pigments in general have been known to be electrically photosensitive (see, for example, U.S. Pat. Nos. 3,903,107 and 3,615,558), the art has not recognized the unique combination of high infrared photosensitivity, high charge acceptance, low dark decay and high quantum efficiency of multiactive elements containing a $\beta$-phase indium phthalocyanine.

Accordingly, the present invention provides a photoconductive element comprising an electrically conductive support, a charge generation layer and a charge transport layer, wherein the charge generation layer comprises the $\beta$-phase of an indium phthalocyanine pigment sensitive to radiation in the infrared region of the electromagnetic spectrum.

Indium phthalocyanines useful in this invention can be unsubstituted or can have substituents associated with the indium atom, the phthalocyanine ring, or both. Preferred substituents, for either or both of the indium atom and the phthalocyanine ring, are halogen atoms such as fluorine, chlorine, bromine and iodine. Other substituents which can be associated with the indium atom are hydroxy, alkoxy, aryloxy, alkylcarbonyloxy, arylcarbonyloxy, siloxy, oxyindium phthalocyanine and acetylacetonate. Other substituents which can be associated with the phthalocyanine ring are alkyl, alkoxy, aryl, aryloxy and fused aromatic carbocylic or nitrogen-containing heterocyclic rings. The alkyl substituents, as well as the alkyl portion of the alkoxy and alkylcarbonyloxy substituents, can contain 1 to 22 carbon atoms. The aryl substituents, as well as the aryl portion of the aryloxy and arylcarbonyloxy substituents, can contain 6 to 22 carbon atoms.

Especially preferred indium phthalocyanines contain chlorine substituents on either or both of the indium atom and the phthalocyanine ring. Thus, especially preferred are chloroindium phthalocyanine, indium chlorophthalocyanine, chloroindium chlorophthalocyanine and mixtures thereof.

Preferred materials can be represented by the structural formula:

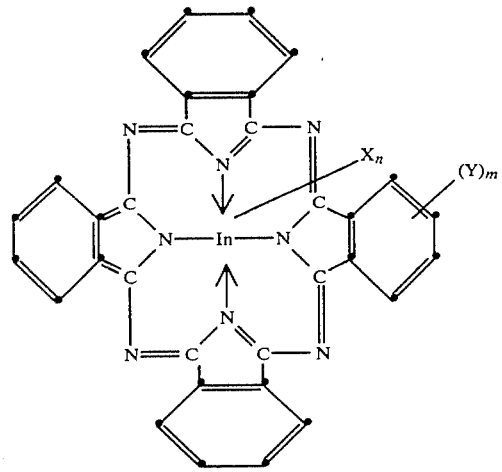

wherein:

Each of X and Y is halogen, preferably chlorine or bromine;

m is 0 to 16; and n is 0 to 1.

Indium phthalocyanines can be prepared by procedures known in the art. Halogen-substituted indium phthalocyanines can be prepared by techniques described in G. P. Shaposhnikov, et al., Izv. Vyssh. Uchebn, Zaved., Khim. Khim. Tekhnol, 1977, 20 (2), 184–6 D. Colaitis, Bull. Soc. Chim., p. 23 (1962); and P. Muehl, Krist. Tech. 1965, 2 (3), 431–5. Representative preparations are shown in the preparative examples hereinafter.

As prepared by these techniques, the indium phthalocyanines are in the β-phase. The photoconductive properties of the materials can be improved by removal of impurities. A preferred purification technique is vacuum sublimation. This technique is especially useful with the halogen-substituted indium phthalocyanines and similar materials which do not undergo significant decomposition at sublimation temperatures. For other materials known purification techniques can be employed which do not heat the material to a temperature at which significant decomposition occurs. Some purification techniques convert the indium phthalocyanine pigment from the preferred β-phase to another form. In that event, the pigment can be converted back to the β-phase by annealing techniques which will be described in more detail hereinafter.

Vacuum sublimation can be effected by placing the indium phthalocyanine pigment in a crucible container in a vacuum deposition apparatus and positioning a substrate relative to the crucible so that pigment subliming from the crucible will be deposited upon the substrate. The vacuum chamber is preferably maintained at a background pressure of between $10^{-3}$ and $10^{-5}$ Pascal. The crucible is heated to the minimum temperature consistent with an adequate rate of sublimation of the pigment. Temperatures in the range of 300° to 400° C. are preferred. It is preferred that the substrate be maintained at a temperature close to room temperature. This can be accomplished by positioning the substrate sufficiently far from the crucible that it is not heated, or by cooling the substrate.

If the pigment contains impurities which are volatile at temperatures below that at which the pigment sublimes, they can be removed by interposing a shutter between the substrate and the crucible and heating the crucible to a temperature below that at which significant sublimation of the indium phthalocyanine pigment occurs. A temperature in the range of about 200° to 250° C. is often suitable. After the impurities have been deposited on the shutter, the shutter is removed and the temperature raised to sublime the pigment onto the substrate.

When deposited on a substrate maintained at room temperature, the indium phthalocyanine pigment is in a very poorly crystalline form, referred to hereinafter as the amorphous phase. Its spectral absorption is shifted bathochromically and its photosensitivity is increased by converting it to the β-phase. This can be accomplished in several ways.

One technique is thermal annealing. This involves heating the pigment for a time within the range of about 5 to 500 seconds at a temperature in the range of about 200° to 300° C. Thermal annealing can be conducted on the pigment as vacuum sublimed, concurrent with the positioning of a charge transport layer, if it is to be vacuum sublimed, or subsequent to the deposition of the charge transport layer if the latter is a material which is not degraded at the temperatures employed for annealing.

A second technique for conversion of the indium phthalocyanine from the amorphous phase to the β-phase involves exposure of the pigment to solvent vapor. Suitable solvents include chlorinated hydrocarbons such as dichloromethane, chloroform, dichloroethane, and trichloroethane, as well as other solvents such as toluene and tetrahydrofuran. The time and temperature of solvent vapor exposure will depend, to some extent, upon the particular solvent selected. Generally, however, times in the range of about 5 to 100 seconds and temperatures in the range of about 40 ° to 80° C. are suitable.

Solvent vapor treatment converts only the surface of the indium phthalocyanine layer. If it is desired to have the β-phase at multiple depths in the charge generation layer, vacuum sublimation of the pigment can be interrupted and solvent vapor conversion effected. This sequence can be performed one or several times.

A third technique for converting the indium phthalocyanine pigment from the amorphous phase to the β-phase is liquid solvent conversion. This techniques involves treating the pigment either on the substrate or after removal from the substrate with a suitable liquid solvent. Solvents identified above as being useful for solvent vapor conversion are suitable as are other solvents such as acetone and dioxane. The pigment should remain in contact with the solvent for a time from about 5 to 100 seconds at a temperature of about 20° to 40° C.

This third technique is particularly useful when it is desired to solvent coat the indium phthalocyanine pigment or when it is desired to coat a charge transport layer over the indium phthalocyanine layer by a solvent treatment. In such situations, conversion of the indium phthalocyanine pigment from the amorphous-phase to the β-phase occurs concurrent with the coating operation. Additionally, when the indium phthalocyanine pigment is solvent coated by this technique, it provides a charge generation layer which is present in the β-phase throughout its volume.

As coated, either by vacuum sublimation or by solvent coating, the charge generation layer can have a thickness within a wide range depending upon the degree of photosensitivity desired. Thickness affects photosensitivity in two opposite ways. As thickness increases a greater proportion of incident radiation is absorbed by the layer, but there is a greater likelihood of a charge carrier being trapped and thus not contributing to image formation. Thus, these two factors must be balanced in selecting an appropriate thickness. We have found that a thickness in the range of about 0.05 μm to 3.0 μm is preferred for maximum photosensitivity. At thicknesses much below 0.05 μm there is inadequate absorption of incident actinic radiation, whereas at thicknesses much above 3.0 μm, there is excessive trapping of charge carriers.

As suggested above in connection with the conversion of the indium phthalocyanine pigment from the amorphous-phase to the β-phase, all of the indium phthalocyanine in the charge generation layer need not be in the β-phase. A portion can be in the amorphous form or in another form. It is preferred, however, that at least 50 percent by volume of the indium phthalocyanine present in the charge generation layer be in the β-phase.

The charge transport layer can be comprised of any material, organic or inorganic, which is capable of transporting charge carriers generated in the charge generation layer. Most charge transport materials preferentially accept and transport either positive charges (holes) or negative charges (electrons), although there are materials known which will transport both positive and negative charges. Transport materials which exhibit a preference for conduction of positive charge carriers are referred to as p-type transport materials whereas those which exhibit a preference for the conduction of negative charges are referred to as n-type.

Various p-type organic charge transport materials may be used in the charge transport layer of the present invention. Any of a variety of organic photoconductive materials which are capable of transporting positive charge carriers may be employed. Representative p-type organic photoconductive materials include:

1. Carbazole materials including carbazole, N-ethyl carbazole, N-isopropyl carbazole, N-phenyl carbazole, halogenated carbazoles, various polymeric carbazole materials such as poly(vinyl carbazole) halogenated poly(vinyl carbazole), and the like.

2. Arylamine containing materials including monoarylamines, diarylamines, triarylamines, as well as polymeric arylamines. A partial listing of specific arylamine organic photoconductors include the non-polymeric triphenylamines illustrated in Klupfel et al U.S. Pat. No. 3,180,730 issued Apr. 27, 1965; the polymeric triarylamines described in Fox U.S. Pat. No. 3,240,597 issued Mar. 15, 1966; the triarylamines having at least one of the aryl radicals substituted having by either a vinyl radical or a vinylene radical having at least one active hydrogen-containing group, as described in Brantly et al U.S. Pat. No. 3,567,450 issued Mar. 2, 1971; the triarylamines in which at least one of the aryl radicals is substituted by an active hydrogen-containing group, as described in Brantly et al U.S. Pat. No. 3,658,520 issued Apr. 25, 1972; and tritolylamine.

3. Polyarylalkane materials of the type described in Noe et al U.S. Pat. No. 3,274,000 issued Sept. 20, 1966; Wilson U.S. Pat. No. 3,542,547 issued Nov. 24, 1970 and in Rule et al U.S. Pat. No. 3,615,402 issued Oct. 26, 1971. Preferred polyarylalkane photoconductors can be represented by the formula:

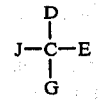

wherein:

D and G, which may be the same or different, represent aryl groups and J and E, which may be the same or different, represent a hydrogen atom, an alkyl group, or an aryl group, at least one of D, E and G containing an amino substituent. An especially useful polyarylalkane photoconductor which may be employed as the charge transport material is a polyarylalkane having the formula noted above wherein J and E represent a hydrogen atom, an aryl group, or an alkyl group and D and G represent substituted aryl groups having as a substituent thereof a group represented by the formula:

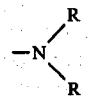

wherein:

R represents an unsubstituted aryl group such as phenyl or an alkyl substituted aryl such as a tolyl group. Additional information concerning certain of these latter polyarylalkanes may be found in Rule et al U.S. Pat. No. 4,127,412 issued Nov. 28, 1978.

4. Strong Lewis base materials such as aromatic materials, including aromatically unsaturated heterocyclic materials which are free of strong electron withdrawing groups. A partial listing of such aromatic Lewis base materials includes tetraphenylpyrene, 1-methylpyrene, perylene, chrysene, anthracene, tetraphene, 2-phenyl naphthalene, azapyrene, fluorene, fluorenone, 1-ethylpyrene, acetyl pyrene, 2,3-benzochrysens, 3,4-benzopyrene, 1,4-bromopyrene, phenylindole, polyvinyl carbazole, polyvinyl pyrene, polyvinyl tetracene, polyvinyl perylene, and polyvinyl tetraphene.

5. Other useful p-type charge-transport materials which may be employed in the present invention are any of the p-type organic photoconductors, including metallo-organo materials, known to be useful in electrophotographic processes, such as any of the organic photoconductive materials described in *Research Disclosure*, Vol. 109, May 1973, pages 61–67, paragraph IV (A) (2) through (13) which are p-type photoconductors. (*Research Disclosure* is published by Industrial Opportunities Limited, Havant, Hampshire, PO9 1EF, United Kingdom.)

Representative of n-type charge-transport materials are strong Lewis acids such as organic, including metallo-organic, materials containing one or more aromatic, including aromatically unsaturated heterocyclic, materials bearing an electron withdrawing substituent. These materials are considered useful because of their characteristic electron accepting capability. Typical electron withdrawing substituents include cyano and nitro groups; sulfonate groups; halogens such as chlorine, bromine, and iodine; ketone groups; ester groups; acid anhydride groups; and other acid groups such as carboxyl and quinone groups. A partial listing of such representative n-type aromatic Lewis acid materials having electron withdrawing substituents include phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrobiphenyl, 2,4,6-trinitroanisole, trichlorotrinitrobenzene, trinitro-o-toluene, 4,6-dichloro-1,3-dinitrobenzene, 4,6-dibromo-1,3-dinitrobenzene, p-dinitrobenzene, chloranil, bromanil, 2,4,7-trinitro-9-fluorenone, 2,4,5,7-tetranitrofluorenone, trinitroanthracene, dinitroacridene, tetracyanopyrene, dinitroanthraquinone, and mixtures thereof.

Other useful n-type charge transport materials which may be employed in the present invention are conventional n-type organic photoconductors, for example, complexes of 2,4,6-trinitro-9-fluorenone and poly(vinyl carbazole). Still other n-type organic, including metallo-organo, photoconductive materials useful as n-type charge transport materials in the present invention are any of the organic photoconductive materials known to be useful in electrophotographic processes such as any of the materials described in *Research Disclosure,* Vol. 109, May 1973, pages 61–67, paragraph IV(A) (2) through (13), which are n-type photoconductors.

A single charge transport layer can be employed or more than one can be employed. Where a single charge transport layer is employed it can be either a p-type or an n-type material.

A preferred configuration of layers is to have the charge generation layer between the conducting support and a single charge transport layer. Since there are a multiplicity of suitable charge transport materials this arrangement provides a great deal of flexibility and permits physical and surface characteristics of the element to be controlled by the nature of the charge transport layer selected.

Where it is intended that the charge generation layer be exposed to actinic radiation through the charge transport layer, it is preferred that the charge transport layer have little or no absorption in the region of the electromagnetic spectrum to which the charge generation layer responds, thus permitting the maximum amount of actinic radiation to reach the charge generation layer. Where the charge transport layer is not in the path of exposure, this consideration does not apply.

Each of the charge generation and charge transport layers can be applied by vacuum deposition or by solvent coating. When solvent coating is employed to coat either or all of these layers a suitable film-forming polymeric binder material can be employed. The binder material may, if it is an electrically insulating material, help to provide the element with electrical insulating characteristics. It also serves as a film-forming material useful in (a) coating the layer, (b) adhering the layer to an adjacent layer, and (c) when it is a top layer, providing a smooth, easy to clean, wear resistant surface.

Where a polymeric binder material is employed in either the charge generation or charge transport layer, the optimum ratio of charge generation or charge transport material to binder material may vary widely depending on the particular polymeric binder(s) and particular charge transport material(s) employed. In general, it has been found that, when a binder material is employed, useful results are obtained wherein the amount of active charge generation or charge transport material contained within the layer varies within the range of from about 5 to about 90 weight percent based on the dry weight of the layer.

A partial listing of representative materials which may be employed as binders in the charge generation and charge transport layers are film-forming polymeric materials having a fairly high dielectric strength and good electrically insulating properties. Such binders include styrene-butadiene copolymers; polyvinyl toluene-styrene copolymers; styrene-alkyd resins; silicone-alkyd resins; soya-alkyd resins; vinylidene chloride-vinyl chloride copolymers; poly(vinylidene chloride); vinylidene chloride-acrylonitrile copolymers; vinyl acetate-vinyl chloride copolymers; poly(vinyl acetals), such as poly(vinyl butyral); nitrated polystyrene; polymethylstyrene; isobutylene polymers; polyesters, such as poly[ethylene-coalkylenebis(alkyleneoxyaryl)-phenylenedicarboxylate]; phenolformaldehyde resins; ketone resins; polyamides; polycarbonates, polythiocarbonates; poly[ethylene-co-isopropylidene-2,2-bis(ethyleneoxyphenylene)terephthalate]; copolymers of vinyl haloacrylates and vinyl acetate such as poly(vinyl-m-bromobenzoate-co-vinyl acetate); chlorinated poly(olefins), such as chlorinated poly(ethylene); etc.

In general, it has been found that polymers containing aromatic or heterocyclic groups are most effective as the binder materials because these polymers, by virtue of their heterocyclic or aromatic groups, tend to provide little or no interference with the transport of charge carriers through the layer. Heterocyclic or aromatic-containing polymers which are especially useful in p-type charge transport layers include styrene-containing polymers, bisphenol A polycarbonate polymers, phenol-formaldehyde resins, polyesters such as poly-[ethylene-co-isopropylidene-2,2-bis(ethyleneoxy-phenylene)]terephthalate, and copolymers of vinyl haloacrylates and vinylacetate such as poly(vinyl-m-bromobenzoate-co-vinyl acetate).

The charge generation and charge transport layers can also contain other addenda such as leveling agents, surfactants, plasticizers, and the like to enhance or improve various physical properties of the layer. In addition, various addenda to modify the electrophotographic response of the element can be incorporated in the charge transport layer. For example, various contrast control materials, such as certain hole-trapping agents and certain easily oxidized dyes can be incorporated in the charge transport layer. Various such contrast control materials are described in *Research Disclosure,* Vol. 122, June 1974, p. 33, in an article entitled "Additives For Contrast Control In Organic Photoconductor Compositions and Elements".

When the charge generation layer or the charge transport layer is solvent coated, the components of the layer are dissolved or dispersed in a suitable liquid together with the binder, if one is employed, and other addenda as described above. Useful liquids include aromatic hydrocarbons such as benzene, naphthalene, toluene, xylene and mesitylene; ketones such as acetone and butanone; halogenated hydrocarbons such as methylene chloride, chloroform and ethylene chloride; ethers including cyclic ethers such as tetrahydrofuran and ethyl ether; and mixtures of the above. Where solvent coating techniques are to be relied upon to convert the indium phthalocyanine from the amorphous phase to the $\beta$-phase the solvent should be one of those previously identified above as being suitable for this purpose.

A variety of electrically conducting supports can be employed in the elements of this invention, such as for example, paper (at a relative humidity above 20 percent); aluminum-paper laminates; metal foils such as aluminum foil, zinc foil, etc.; metal plates such as aluminum, copper, zinc brass and galvanized plates; vapor deposited metal layers such as silver, chromium, nickel, aluminum and the like coated on paper or conventional photographic film bases such as poly(ethylene terephthalate), cellulose acetate, polystyrene, etc. Such conducting materials as chromium, nickel, etc. can be vacuum deposited on transparent film supports in sufficiently thin layers to allow electrophotographic elements prepared therewith to be exposed from either side of such elements. An especially useful conducting support can be prepared by coating a support material such as poly(ethylene terephthalate) with a conducting layer containing a semiconductor dispersed in a resin. Such conducting layers both with and without electrical barrier layers are described in U.S. Pat. No. 3,245,833 by Trevoy, issued Apr. 12, 1966. Other useful conducting layers include compositions consisting essentially of an intimate mixture of at least one protective inorganic oxide and from about 30 to about 70 percent by weight of at least one conducting metal, e.g., a vacuum-deposited cermet conducting layer as described in Rasch U.S. Pat. No. 3,880,657 issued Apr. 29, 1973. Likewise, a suitable conducting coating can be prepared from the sodium salt of a carboxyester lactone of maleic anhydride and a vinyl acetate polymer. Such kinds of conducting layers and methods for their optimum preparation and use are disclosed in U.S. Pat. Nos. 3,007,901 by Minsk issued Nov. 7, 1961 and 3,262,807 by Sterman et al issued July 26, 1966.

The various layers of the element can be coated directly to the conducting substrate. In some cases, it may be desirable to use one or more intermediate subbing layers over the conducting substrate to improve adhesion between the conducting substrate and overlying layers or to act as an electrical barrier layer between the overlying layers and the conducting substrate, as described in Dessauer U.S. Pat. No. 2,940,348. Such subbing layers, if used, typically have a dry thickness in the range of about 0.01 to about 5 microns. Typical subbing layer materials which may be used include film-forming polymers such as cellulose nitrate, polyesters, copolymers of poly(vinyl pyrrolidone) and vinylacetate, and various vinylidene chloride-containing polymers including two, three and four component polymers prepared from a polymerizable blend of monomers or prepolymers containing at least 60 percent by weight of vinylidene chloride. A partial list of representative vinylidene chloride-containing polymers includes vinylidene chloride-methyl methacrylate-itaconic acid terpolymers as disclosed in U.S. Pat. No. 3,143,421. Various vinylidene chloride containing hydrosol tetrapolymers which may be used include tetrapolymers of vinylidene chloride, methyl acrylate, acrylonitrile and acrylic acid as disclosed in U.S. Pat. No. 3,640,708. A partial listing of other useful vinylidene chloride-containing copolymers includes poly(vinylidene chloride-methyl acrylate), poly(vinylidene chloride-methacrylonitrile), poly(vinylidene chloride-acrylonitrile), and poly(vinylidene chloride-acrylonitrile-methyl acrylate). Other useful subbing materials include the so-called tergels which are described in Nadeau et al U.S. Pat. No. 3,501,301 and the vinylidine chloride terpolymers described in Nadeau U.S. Pat. 3,228,770.

One especially useful subbing layer which can be employed in the elements of the invention is a hydrophobic film-forming polymer or copolymer free from any acid-containing group, such as a carboxyl group, prepared from a blend of monomers or prepolymers, each of said monomers or prepolymers containing one or more polymerizable ethylenically unsaturated groups. A partial listing of such useful materials includes many of the above-mentioned copolymers, and in addition, the following polymers: copolymers of polyvinylpyrrolidone and vinyl acetate, poly(vinylidene chloride-methyl methacrylate), and the like.

Optional overcoat layers can be used in the elements of the present invention, if desired. For example, to improve surface hardness and resistance to abrasion, the surface layer of the element of the invention can be coated with one or more electrically insulating, organic polymer coatings or electrically insulating, inorganic coatings. A number of such coatings are well known in the art and accordingly extended discussion thereof is unnecessary. Typical useful such overcoats are described for example, in *Research Disclosure,* "Electrophotographic Elements, Materials and Processes", Vol. 109, p. 63, Paragraph V, May 1973.

The photoconductive elements of this invention can be used in the ways and for the purposes that such elements are used in the art. While it is expected that they will find principle use as electrophotographic elements in the art of electrophotography, they can also be used in other arts, such as the solar cell art, where photoconductive elements are employed.

The following examples further illustrate the invention.

PREPARATIVE EXAMPLE 1

Preparation of Chloroindium Chlorophthalocyanine

Phthalonitrile (160 g, 1.25 M) and anhydrous indium trichloride (99% pure, 70.4 g, 0.32 M) were combined in a 500 mL 3 neck flask and heated under nitrogen with stirring for 1 hour at 163° C., the flask being completely submerged in a salt bath. The temperature was then raised over a period of 1 hour to a final temperature of 285° C. The product was allowed to cool and solidify, was ground with a mortar and pestle, and then was slurried at room temperature in 2400 ml of toluene and 2400 ml of acetone. It was then extracted with acetone until the effluent was colorless (approximately 2 days). The product was slurried 3 times with 2400 ml of distilled water, then with 2400 ml of acetone and then was dried in a vacuum oven at 114° C. overnight. Yield: 116.8 g, equivalent to 57%. Analyses were as follows:

1. Absorption Spectrum See FIG. 1. In this Figure, the curve labelled "1" is the absorption spectrum for the material freshly sublimed as in Example 1 infra, while that labelled "2" is the absorption spectrum for the material after thermal annealing for 5 seconds at 300° C.

2. Mass Spectral Analysis

| | | |
|---|---|---|
| 499 | unidentified | |
| 514 | $PcH_2$ | |
| 548 | $ClPcH_2$ | |
| 662 | ClInPc | MAJOR PEAK |
| 696 | ClInClPc | |
| 730 | $ClInCl_2Pc$ | |

3. Elemental Analysis $ClInCl_{(0.67)}Pc$:

| | C | H | N | Cl |
|---|---|---|---|---|
| EXP. | 56.9 | 2.3 | 16.7 | 8.6 |
| CALC. | 56.1 | 2.3 | 16.3 | 8.6 |

4. Water Analysis: 0.2%

PREPARATIVE EXAMPLE 2

Preparation of Acetylacetonato Indium Phthalocyanine 51.2 g (0.40 M) phthalonitrile, 41.2 g (0 15 M) indium triacetylacetonate and 60.8 g (0.40 M) 1,8-diazabicyclo[5.4.0]undec-7-ene were added to a flask containing 2000 ml dry ethanol. The mixture was heated at reflux under a nitrogen atmosphere for 24 hours. The hot solution was filtered through a medium porosity sintered glass funnel. The solid was washed by slurrying once with ethanol and once with water and extracted in a Soxhlet extractor with acetone until the effluent was colorless. The product was collected on a funnel and dried at 114° C. overnight in a vacuum oven. The product was recrystallized from β-chloronaphthalene. The solid obtained from recrystallization was extracted in a Soxhlet extractor with acetone until the effluent was colorless. The product was collected on a funnel and dried at 60° C. overnight in a vacuum oven to yield 25.3 g of blue solid (35%).

Elemental analysis calculated for: $C_{37}H_{23}N_8O_2In$ (726): C, 61.2; H, 3.2; N,15.4; 0, 4.4; In, 15.8. Found: C, 61.2; H, 3.2; N, 15.4; 0, 5.8;In; 16.9.

M.W. determined by field desorption mass spectrometry is 726.

Characteristic bands in the infrared spectra due to the acetyl acetoxy group appear at 1580 $cm^{-1}$ and 1510 $cm^{-1}$.

PREPARATIVE EXAMPLE 3

Preparation of Triphenylsiloxy Indiumphthalocyanine 1 g ($1.38\times10^{-3}$ M) acetylacetonatoindiumphthalocyanine and 0.76 g ($2.76\times10^{-3}$ M) triphenyl silanol were added to a flask containing 50 ml of toluene and the reaction mixture was heated at reflux for 17 hours. The hot reaction mixture was filtered through a medium porosity sintered glass funnel and was washed by slurrying with acetone. The product was dried at 114° C. overnight in a vacuum oven to yield 0.9 g of a blue solid 72%. M.W. determined by field desorption mass spectrometry 902. Infrared spectrum of product contains band at 700 $cm^{-1}$ that is characteristic of the out of plane bending of C-H bonds in substituted benzene.

PREPARATIVE EXAMPLE 4

Preparation of Acetoxy Indiumphthalocyanine 1 g ($1.38\times10^{-1}$ M) acetylacetonato indiumphthalocyanine, was added to a flask containing 48 ml glacial acetic acid and 2 ml of water. The reaction mixture was heated at reflux for 17 hours and was filtered while still hot through a medium porosity sintered glass funnel. The solid was washed once with methanol, twice with water, and finally once with methanol, before being dried in a vacuum oven at 114° C. overnight. 0.45 (48%) of blue solid were obtained. Field desorption mass spectrum shows molecular weight to be 686 band in the infrared spectrum characteristic of the acetoxy group found at 1405 $cm^{-1}$.

PREPARATIVE EXAMPLE 5

About 2 to 3 grams of chloroindium chlorophthalocyanine prepared as in preparative Example 1 was placed in a tantalum crucible (R. D. Mathis Co., Model SM-8) and mounted in a vacuum deposition apparatus (Varian Vacuum Equipment Model 3117). A substrate, consisting of a 10 cm×10 cm×2 cm hollow aluminum plate, was placed above the center of the crucible at a distance of approximately 17 cm. The substrate was cooled with liquid nitrogen. A shutter, positioned between the crucible and the substrate at a distance of approximately 4 cm from the crucible, was placed in the closed position during evacuation and initial heating.

After evacuation to about $13\times10^{-5}$ Pascal, the crucible was heated to about 200° C. At this temperature, low temperature volatile impurities present in the chloroindium chlorophthalocyanine sublimed and condensed on the surface of the shutter. The 200° C. temperature was maintained for 5–10 minutes. (The exact time required for purification depends mainly on crucible size and the amount of material to be purified.)

Next, the temperature of the crucible was increased to about 500°–520° C. Once this temperature was reached, the shutter was opened. A quartz crystal deposition rate monitor, positioned adjacent to the substrate was used to indicate sublimation of chloroindium chlorophthalo-cyanine. After a few minutes at 500°–520° C., deposition rates between 100–500 A/sec were observed. Deposition was continued until the deposition rate decreased to about 10 A/sec. The crucible was then allowed to cool to about 100° C. and the vacuum removed.

A thick film of chloroindium chlorophthalcyanine was obtained on the deposition substrate. This deposit was removed by scraping from the substrate with a sharp blade.

EXAMPLE 1

Indium phthalocyanines can be converted to the β phase by thermal annealing or solvent vapor treatment. This example illustrates both techniques.

Three elements were prepared, each comprising, in order, a nickel coated glass substrate, a 0.2 μm chloroindium chlorophthalocyanine charge generation layer and a 10 μm 1,1-bis(4-di-p-tolylaminophenyl)cyclohexane charge transport layer. Both the charge generation and charge transport layers were thermally sublimed from a tantalum crucible in a vacuum deposition apparatus evacuated to a background pressure of $2.6\times10^{-5}$ Pascal. The glass substrate was mounted 20 cm from the crucible and was maintained at room temperature (23° C.) throughout the deposition of both layers. Both layers were deposited at a rate of about 10 A/sec.; the crucible being heated to a temperature of 350° C. during the deposition of the charge generation layer and to a temperature of 200° C. during the deposition of the charge transport layer. During the preparation of the elements, individual ones of the charge generation layers were treated as follows:

1. Control - the charge generation layer was not intentionally heated or solvent exposed prior to the deposition of the transport layer.

2. Solvent converted - the charge generation layer was exposed to dichloromethane vapor for 60 minutes at room temperature prior to the deposition of the transport layer.

3. Thermally converted - the charge generation layer was heated to 300° C. in air for 5 seconds prior to the deposition of the transport layer.

Figure 2:
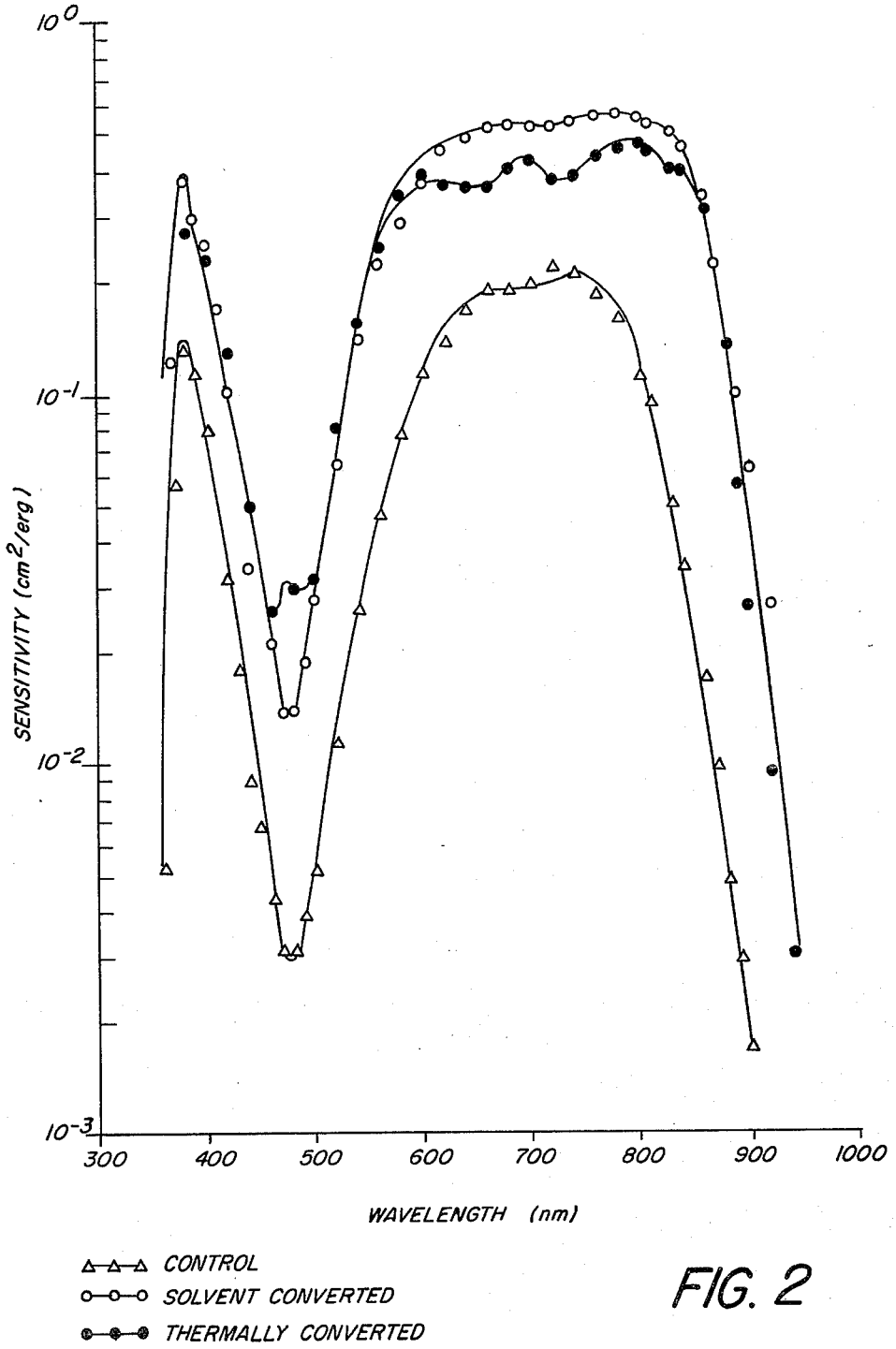

The results of potential discharge measurements on each of the elements are illustrated in FIG. 2. The data are expressed as xerographic sensitivity which is defined as the reciprocal of the energy (in ergs/$cm_2$) to discharge a corona charged photoreceptor from 500 to 300 volts.

Observations of these data indicate that:

1. The magnitude of the sensitivity of the solvent converted sample is equivalent to the thermally converted sample and approximately a factor of 2 greater than the control.

2. Relative to the control, the long wavelength edge of the action spectra of the solvent or thermally converted sample is shifted to longer wavelengths by about 60 nm.

EXAMPLE 2

This example illustrates the use of a solvent dispersion technique to convert the indium phthalocyanine to the $\beta$-phase and the solvent coating of both the charge generation and charge transport layers.

| Charge Generation Layer | |
|---|---|
| Dispersion Preparation | |
| Zirconium beads | 90.0 g |
| Polycarbonate binder solution (see below) | 20.9 g |
| Chloroindium chlorophthalocyanine (from Preparative Example 5) | 1.08 g |
| Methylene chloride | 14.0 g |
| Siloxane surfactant (10%)(DC 510 sold by Dow Corning) | .04 g |
| Polycarbonate Binder Solution | |
| 5.25 g Bisphenol A polycarbonate $\eta = 2.7$ | |
| 120.0 g Methylene chloride | |
| 78.0 g 1,1,2-Trichloroethane | |
| Charge Transport Layer | |
| 1,1-Bis(4-di-p-tolylaminophenyl)cyclohexane | 15.0 g |
| Tritolylamine | 15.0 g |
| Lexan 145 polycarbonate | 45.0 g |
| Methylene chloride | 493.2 g |
| 1,1,2-trichloroethane | 54.0 g |
| Siloxane surfactant (1O%) (DC 510 sold by Dow Corning) | .6 g |

The charge generation layer formulation was agitated on a paint shaker for two hours and then diluted with methylene chloride to 3.5% solids, filtered and coated to yield a dry thickness of 1 $\mu$m on a poly(ethylene terephthalate) support.

Figure 3:
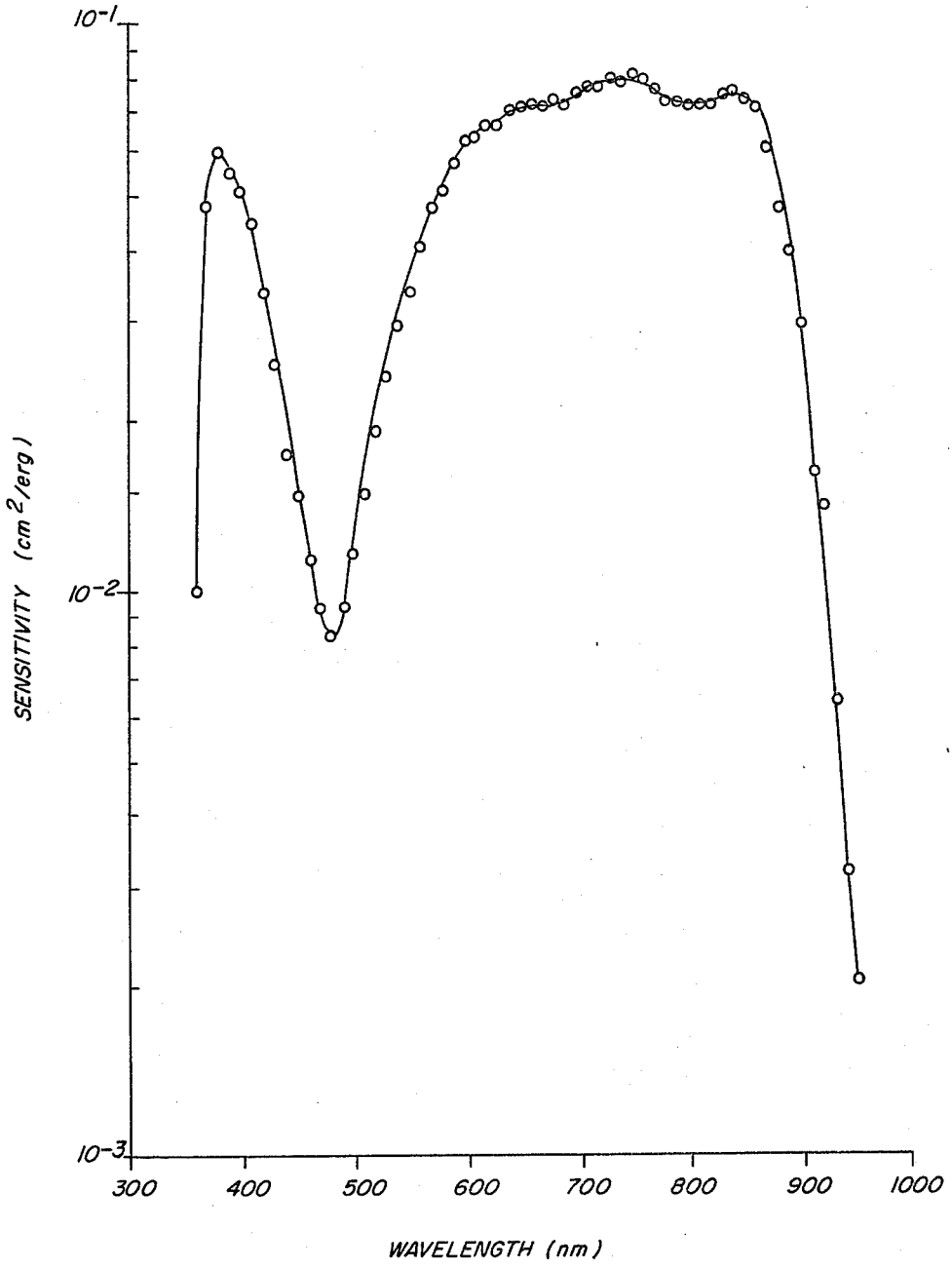

The charge transport layer formulation was coated over the charge generation layer to yield a dry thickness of 10 $\mu$m. The xerographic sensitivity of the element, measured as in Example 1, is shown in FIG. 3. It will be noted that the material shows good sensitivity out to about 900 nm.

EXAMPLE 3

Comparison With Single Layer Materials

The high sensitivity of indium phthalocyanines is obtained only with the combination of a $\beta$-phase layer electrically contiguous to a charge transport layer. To illustrate this, two 1.0 $\mu$m single layer control element of chloroindium chlorophthalocyanine were prepared. Control 1 was not treated afterwards. Control 2 was exposed to dichloromethane vapor for 5 seconds. In an element according to this invention a 0.2 $\mu$m chloroindium chlorophthalocyanine charge generation layer was exposed to dichloromethane vaport for one hour and then a 17 $\mu$m transport layer of 1,1,-bis(4-di-p-tolylaminophenyl)cyclohexane was vacuum sublimed thereover. Each element employed on a poly(ethylene terephthalate) support. In Table I, the results of a series of potential discharge measurements made with these elements are summarized. Quantum efficiency is defined as the ratio of the decrease of the surface charge density to the incident photon flux, assuming charge density is related to surface voltage by the geometrical capacitance. Defined in this manner, the maximum efficiency is unity. The potential discharge measurements were made at 810 nm with an electric field of $8\times10^4$ V/cm.

TABLE I

| Sample | Transport Layer | Quantum Efficiency |
|---|---|---|
| Control 1 | None | $10^{-4}$ |
| Control 2 | None | $10^{-4}$ |
| Invention | 1,1-bis(4-di-p-tolylaminophenyl)cyclohexane | 0.30 |

EXAMPLE 4

Comparison With Other Phthalocyanines

A series of elements was prepared each having a different phthalocyanine charge generation layer. The elements had the following layers, in order: a nickel-coated, poly(ethylene terephthalate) support, a polyester blocking layer, a 0.2 $\mu$m charge generation layer and a 10 $\mu$m charge transport layer. The charge generation layer was composed of one of the phthalocyanines, identified below, vacuum sublimed from a tantalum crucible at a temperature of 350° C. and a background pressure of $2\times10^{-3}$ Pascal. The charge transport layer was composed tri-p-tolylamine in bisphenol A polycarbonate coated from a solvent mixture of methylene chloride and 1,1,2-trichloroethane.

The results of measurements of charging dark decoy and xerographic photosensitivity, made on these elements, are shown below.

A. Materials that show little charge acceptance:

1. Sn-Pc: Charges to about −150 V. Dark discharge is 15 V/sec.
2. Ag-Pc: Charges to −40 V. Dark discharge is 70 V/sec.
3. Fe-Pc: Charges to −40 V. Dark discharge is 20 V/sec.
4. $H_2$-Pc: Cannot be charged in excess of −10 V.
5. Ni-Pc: Cannot be charged in excess of −2 V.

B. Materials that show good charge acceptance, but very high rates of dark discharge:

1. Zn-Pc: Charges to −500 V. Dark discharge is 70 V/sec.
2. Co-Pc: Charges to −400 V. Dark discharge is 40 V/sec.
3. VO-Pc: Charges to −500 V. Dark discharge is 90 V/sec.

C. Materials with good charge acceptance, low rates of dark discharge, but little photosensitivity:

1. Cr-Pc: Charges to −500 V. Dark discharge is 5 V/sec. Shows very little photosensitivity.
2. Mn-Pc: Charges to −500 V. Dark discharge is 2 V/sec. Shows no measurable photosensitivity.

D. Material of this Invention:

1. ClIn-ClPc: Charges to −500 V. Dark discharge is 2 V/sec. Shows excellent photosensitivity.

EXAMPLE 5

Variation In The Transport Layer

In this example, the results obtained with a series of different compounds in the transport layer are shown. In the table below: exposure refers to the energy, in ergs/cm$^2$, required to discharge the corona charged element from 500 to 100 volts. All exposures were made with an excitation wavelength of 810 nm. With the exception of Element 6, all transport layers were coated from a solution of 1,2-dichloromethane. The transport layer of Element 6 was vacuum sublimed. In all cases, the charge generation layer comprised a 0.2 μm layer of chloroindium chlorophthalocyanine converted to the β-phase by solvent vapor treatment as in Example 1.

TABLE II

| Element | Transport Layer | Exposure (ergs/cm$^2$) |
|---|---|---|
| 1 | 1,1-bis(4-di-p-tolylamino-phenyl)cyclohexane (30%): bisphenol-A-polycarbonate (70%) | 7.9 |
| 2 | tri-p-tolylamine (30%): bisphenol-A-polycarbonate (70%) | 13.0 |
| 3 | triphenylamine (30%): bisphenol-A-polycarbonate (70%) | 13.4 |
| 4 | Poly(N—vinylcarbazole) | 13.7 |
| 5 | 4,4'-benzylidene bis(N,N—diethyl-m-toluidine) (30%): bisphenol-A-poly-carbonate (70%) | 28.3 |
| 6 | 1,1-bis(4-di-p-tolylamino-phenyl)cyclohexane | 16.6 |

From these results, it is apparent that there is a wide choice of useful transport layer materials and thus the transport layer can be chosen to provide the optimum physical properties for the use intended.

EXAMPLE 6

Variations In Solvent Vapor Treatment

This example illustrates that the solvent induced enhancement of xerographic sensitivity can be produced by many solvents. Table III reports the xerographic exposure ($E_x$) required to discharge a corona charged element from 500 to 100 volts at wavelengths of 810 and 850 nm. In all elements the charge generation layer was a 0.2 μm layer of chloroindium chlorophthalocyanine prepared by vacuum sublimation as in Example 1. All solvent vapor exposures were for 60 minutes. After solvent vapor exposure, a 10 μm transport layer of 1,1-bis(4-di-p-tolyl-aminophenyl)cyclohexane was vacuum deposited over the charge generation layer.

TABLE III

| Element | Solvent | $E_x(\lambda = 810)$ (ergs/cm$^2$) | $E_x(\lambda = 850)$ (ergs. cm$^2$) |
|---|---|---|---|
| 1 | 1,1,2-trichloro-ethane | 3.3 | 5.0 |
| 2 | toluene | 3.4 | 3.4 |
| 3 | 1,2-di-chloro-ethane | 4.5 | 5.0 |
| 4 | tetrahy-drofuran | 4.7 | 4.4 |
| 5 | chloro-form | 5.3 | 5.2 |
| 6 | untreat-ed control | 16.6 | 87.0 |

TABLE III-continued

EXAMPLE 7

Variations In Time Of Solvent Treatment

The length of solvent vapor exposure can be varied widely, as illustrated in Table IV. The measurements were made using elements as described in Example 6 which had been solvent vapor treated with tetrahydrofuran for the time indicated in the table.

TABLE IV

| Sample | Exposure Time | $E_x(\lambda = 810)$ (ergs/cm$^2$) | $E_x(\lambda = 850)$ (ergs. cm$^2$) |
|---|---|---|---|
| 1 | 60 minutes | 4.5 | 4.4 |
| 2 | 30 minutes | 5.6 | 5.3 |
| 3 | 15 minutes | 3.7 | 3.2 |
| 4 | 5 minutes | 3.5 | 4.0 |
| 5 | Untreated control | 16.6 | 87.0 |

EXAMPLE 8

While the effect of the solvent conversion is believed to be largely limited to the surface region of the charge generation layer, this effect can be extended into the volume of the layer by multiple solvent exposures.

A 0.1 μm film of chloroindium chlorophthalocyanine was formed by vacuum deposition using the procedures described in Example 1. This initial layer was removed from vacuum and subject to dichloromethane vapor treatment for about 30 minutes. This procedure was repeated two additional times giving a 0.3 μm thick charge generation layer composed of three stacked 0.1 μm layers, the free surface of each layer having been solvent converted. A 17 μm transport layer of 1,1,bis(4-di-p-tolylaminophenyl)cyclohexane was then vacuum deposited over the multilayer emitter structure.

The results of potential discharge measurements on this material are as follows:

Peak sensitivity is 0.50 cm$^2$/erg (corresponding to an exposure of 2.0 ergs/cm$^2$) at 810 nm. At 900 nm, the corresponding figures are 0.15 cm$^2$/erg and 7.0 erg/cm$^2$, respectively.

This invention has been described in detail with certain preferred embodiments thereof, but it will be understood that variations and modifications can be effected within the spirit and scope of the invention.

What is claimed is:

1. In a photoconductive element comprising an electrically conductive support, a charge generation layer and a charge transport layer, the improvement wherein the charge generation layer comprises the β-phase of an indium phthalocyanine pigment sensitive to radiation in the infrared region of the electromagnetic spectrum.

2. An element of claim 1, wherein the indium phthalocyanine is a halogen-substituted indium phthalocyanine.

3. An element of claim 2, wherein the indium phthalocyanine is selected from chloroindium phthalocyanine, indium chlorophthalocyanine, chloroindium chlorophthalocyanine and mixtures thereof.

4. An element of claim 2 wherein the indium phthalocyanine is represented by the structure:

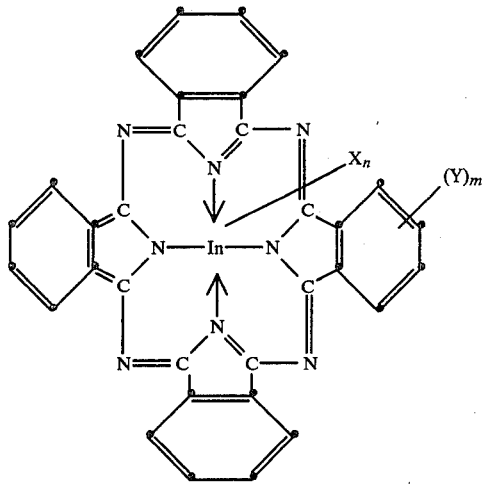

wherein:

Each of X and Y is halogen;

m is 0 to 16; and n is 0 to 1.

5. An element of claim 4, wherein X and Y are each chlorine.

6. An element of claim 5, wherein m is 0 to 2.

7. An element of any one of claims 1, 2 or 3, wherein the charge generation layer has a thickness of between about 0.05 to 3.0 μm and the charge transport layer has a thickness of about 5 to 50 μm.

8. An element of claim 7, wherein at least 50% by volume of the indium phthalocyanine in the charge generation layer is present in the β-phase.

9. An element of claim 1, wherein the charge generation layer comprises vacuum deposited indium phthalocyanine.

10. An element of claim 9, wherein the charge generation layer comprises thermally annealed β-phase indium phthalocyanine.

11. An element of claim 9, wherein the charge generation layer comprises solvent converted β-phase indium phthalocyanine.

12. An element of claim 1, wherein the charge transport layer comprises an n-type charge transport material.

13. An element of claim 1, wherein the charge transport layer comprises a p-type charge transport material.

14. An element of claim 13, wherein the charge transport material is an arylamine photoconductor, an arylalkane photoconductor or combinations thereof.

15. An element of claim 14, wherein the charge transport layer comprises 1,1-bis(4-di-p-tolylaminophenyl)-cyclohexane.

16. An element of any one of claims 13, 14 or 15 wherein the charge transport layer comprises vacuum deposited charge transport material.

17. An element of any one of claims 13, 14 or 15, wherein the charge transport layer comprises solvent coated charge transport material.

18. An element of claim 17, wherein the charge transport layer further comprises a polymeric binder.

19. An element of claim 18, wherein the polymeric binder is a polycarbonate.

20. An element of claim 17, wherein the charge transport material is a polymeric photoconductor.

21. An element of claim 1, wherein the support is a polymeric film bearing a conducting layer on the surface adjacent the charge generation and charge transport layers.

22. An element of claim 21, further comprising a blocking layer between the conducting layer and the charge generation and charge transport layers.

23. An electrophotographic element sensitive to the infrared region of the electromagnetic spectrum comprising a polymeric film support bearing the following layers, in order:

(a) an electrically conducting layer;

(b) a blocking layer;

(c) a charge generation layer having a thickness of between about 0.05 and 3.0 μm and comprising the β-phase of a halogen-substituted indium phthalocyanine pigment; and (d) a charge transport layer having a thickness of between about 5 and 50 μm and comprising a p-type charge transport material.

24. An element of claim 23, wherein the indium phthalocyanine is selected from chloroindium phthalocyanine, indium chlorophthalocyanine, chloroindium chlorophthalocyanine and mixtures thereof and the charge transport material comprises an arylamine photoconductor, an arylalkane photoconductor or combinations thereof.

25. An element of claim 23, wherein the indium phthalocyanine is chloroindium chlorophthalocyanine and the charge transport material comprises 1,1-bis(4-di-p-tolylaminophenyl)cyclohexane.

26. An element of any one of claims 23, 24 or 25, wherein the charge transport layer further comprises a polymeric binder.

27. An element of claim 26, wherein the binder is a polycarbonate.

28. An element of any one of claims 23, 24 or 25, wherein at least 50% by volume of the indium phthalocyanine in the charge generation layer is present in the β-phase.

29. An element of any one of claims 23, 24 or 25, wherein the charge generation layer further comprises a polymeric binder.

30. An element of claim 29, wherein the binder is a polycarbonate.

* * * * *